United States Patent [19]

Mykkanen

[11] Patent Number: 4,757,421

[45] Date of Patent: Jul. 12, 1988

[54] SYSTEM FOR NEUTRALIZING ELECTROSTATICALLY-CHARGED OBJECTS USING ROOM AIR IONIZATION

[75] Inventor: Fred Mykkanen, Minneapolis, Minn.

[73] Assignee: Honeywell Inc., Minneapolis, Minn.

[21] Appl. No.: 55,601

[22] Filed: May 29, 1987

[51] Int. Cl.[4] ..... H05F 3/09

[52] U.S. Cl. ..... 361/231; 361/235

[58] Field of Search ..... 361/213, 229-231, 361/235; 323/903; 55/105, 139

[56] References Cited

U.S. PATENT DOCUMENTS

| | | | |
|---|---|---|---|
| 3,143,403 | 8/1964 | Swensen | 55/15 L |
| 3,292,042 | 12/1966 | Michener et al. | 361/235 |
| 3,308,344 | 3/1967 | Smith et al. | 361/230 |
| 3,699,355 | 10/1972 | Giaimo | 361/235 |
| 3,936,698 | 2/1976 | Meyer | 361/235 |
| 4,027,201 | 5/1977 | Bacon et al. | 361/213 |
| 4,290,003 | 9/1981 | Lanese | 323/903 |
| 4,410,849 | 10/1983 | Ando | 323/905 X |
| 4,445,911 | 5/1984 | Lind | 329/903 |
| 4,476,514 | 10/1984 | Mykkanen | 361/229 |
| 4,477,263 | 10/1984 | Shaver et al. | 361/235 |
| 4,486,704 | 12/1984 | Gustafsson et al. | 323/903 |
| 4,486,808 | 12/1984 | Cardone | 361/235 |
| 4,498,116 | 2/1985 | Saurenman | 361/229 |
| 4,517,143 | 5/1985 | Kisler | 361/225 |
| 4,528,612 | 7/1985 | Spengler | 361/231 |
| 4,536,698 | 8/1985 | Shevalenko et al. | 323/903 |
| 4,542,434 | 9/1985 | Gehlke et al. | 361/231 |
| 4,562,522 | 12/1985 | Adams et al. | 361/235 |

*Primary Examiner*—L. T. Hix
*Assistant Examiner*—D. Rutledge
*Attorney, Agent, or Firm*—Orrin M. Haugen; Thomas J. Nikolai; Frederick W. Niebuhr

[57] ABSTRACT

A room air ionization system for removing electrostatic charge from objects within the room in which one or more pairs of spaced-apart bus bars are equipped with regularly spaced, sharply pointed pins such that when the bus bars are energized with a predetermined high voltage, ions are emitted from the pointed electrodes to flood the room with approximately equal numbers of positive and negative ions. When the ions are electrically attracted to bodies exhibiting an electrostatic charge of opposite polarity, the charges are effectively neutralized. Because, in systems of this type, there is a tendency for particles of dirt to be attracted to the bus bars, spacers and surrounding ceiling and wall surfaces, frequent cleaning is usually necessary. In accordance with the present invention, however, the bus bars are appropriately pulsed with voltages of opposing pluralities and at a predetermined duty cycle on an alternating basis whereby dirt particles are attracted and repelled rather than being constantly attracted. The timed switching of the polarity of the applied voltages to the bus bar pairs thus results in less soiling of the ionization apparatus and surrounding surfaces as compared to prior art systems.

7 Claims, 4 Drawing Sheets

SYSTEM FOR NEUTRALIZING ELECTROSTATICALLY-CHARGED OBJECTS USING ROOM AIR IONIZATION

BACKGROUND OF THE INVENTION

I. Field of the Invention

This invention relates generally to apparatus for effectively eliminating electrostatic discharge problems in laboratory and/or manufacturing facilities, and more particularly to a room air ionization system wherein aesthetic and maintenance problems resulting from unsightly dirt buildup is significantly reduced.

II. Discussion of the Prior Art

Electrostatic discharge (ESD) is of considerable concern to electronic systems manufacturers, especially where semiconductor devices, including microcircuits, are being manufactured, handled or assembled onto printed circuit cards. As the complexity of microcircuits increases and the spacing between the microscopically fine lines and active elements decrease, the propensity to damage caused by static electricity discharges significantly increases. Failure of one or more discrete elements within an integrated circuit package may render an entire electronic assembly inoperative, requiring replacement and costly rework.

In combating ESD problems, electronics manufacturers have developed various approaches for reducing the buildup of potentially damaging electrostatic voltages on objects, such as tools, test equipment and persons working with those devices. For example, raising the relative humidity in the work area to approximately 40% or more causes a decay of electrostatic charge, but this can and often does lead to worker discomfort as well as a relatively long charge decay time. A high humidity environment also leads to various other manufacturing problems and can impact product reliability adversely. Personal grounding wrist straps, grounding pads, conductive floors and anti-static fabrics may be used in an effort to reduce the ESD potentials below the sensitivity rating of the electronic components being handled. The above approaches are of varying effectiveness and have their own drawbacks unique to the particular approaches employed.

In the Mykkanen et al U.S. Pat. No. 4,476,514, which is assigned to the assignee of the present invention, there is described a system for maintaining a degree of ionization in the atmosphere of work spaces which will result in neutralization of static electric charges. Spaced pairs of insulated conductors are suspended proximate the ceiling of the work area and are maintained at constant high positive and negative potentials with respect to ground. At regularly spaced locations along the lengths of the positive and negative bus bars are ion-producing electrodes in the form of sharply pointed pins which penetrate the insulation and contact the conductive portion of the bus bars. The voltage applied to the bus bars is sufficiently high to create a corona discharge at the electrode points.

The system described effectively obviates electrostatic discharge problems in the work environment by flooding the area with essentially equal numbers of positive and negative ions. These ions are electrically attracted to electrostatic charges of opposite polarity existing in the work area and neutralize such charges to the point where voltage breakdowns which could potentially damage sensitive electronic components are eliminated. The charge decay time using the ionization scheme is much more rapid than when 40% relative humidity is used.

The system described in the aforereferenced patent, employs dual emitter lines which are continuously energized by a constant amplitude DC voltage, one line being energized with a positive potential relative to ground and the other with a negative potential relative to ground. Thus, the high voltage current effectively flows in one direction through the individual emitter lines. This has been found to cause the positive emitter bars and surrounding objects in close proximity to the dual emitter lines to become dirty within a fairly short time. When it is considered that considerable time and money may be required to maintain the facility in an aesthetically pleasing condition, any way to reduce the frequency of the necessary cleaning operation constitutes an overall benefit to the company in question.

It is also known that the effectiveness of room ionization system in preventing ESD has a considerable dependence upon the spacing or distance between the item bearing the electrostatic charge and the ion generation grid structure. It is found that at points close to an emitter pin, discharge of an electrostatically charged sample of the same polarity as the ions being emitted from the emitter needle in question is significantly slower than that which is observed at a somewhat greater separation between the sample and the emitter needle. This is due to the fact that at locations very close to the emitter pin, opposite polarity ions have had little time in which to mix. In addition, the ion wind from the emitter needles does have some force near those needles and can, within limits, overcome the repulsion of a like charged object and actually add additional charge to it. This is referred to as "proximity charging" and is undesirable.

SUMMARY OF THE INVENTION

In accordance with the present invention, there is provided a room ionization system for effectively eliminating static electric discharge phenomena in which at least one pair of elongated, spaced-apart, insulated wire conductors are suspended in the room to be treated and each of the wire conductors has a series of emitter bars coupled thereto along their length for maintaining the desired spacing between the conductors and for providing a means whereby a plurality of sharply pointed conductive pins having one end in electrical contact with the wire conductors and the other end available for producing a high voltage corona discharge. The conductive wires are coupled through a pulsing control means to first and second sources of direct current voltage, the respective sources being of opposite polarity. The pulsing control means cyclicly and simultaneously alternates the polarity of the direct current voltage applied to the pair of wire conductors resulting at all times in a 180 degree phase difference between the bus bar voltages. By periodically reversing polarities, mixed waves of positive and negative air ions emante from the emitter pins and propagate through the room due to a charge transfer process which results from the collisions of the ionized molecules with neutral molecules. When these mixed waves of positive and negative ions encounter objects bearing a static charge of a given polarity, the air ions of the opposite polarity mate with the surface charge and neutralize it.

It has been found that the cyclic reversals of the polarities of the direct current voltages applied to the spaced pair of conductors not only results in the generation of waves of ions of mixed polarity, but also that the tendency for particles of dirt to become charged and attracted to the conductors, emitter bars and surrounding room surfaces is markedly reduced when compared to what occurs when fixed DC potentials are continuously applied to the insulated wire conductor pairs.

The use of synchronized 180° out of phase, continuous, simultaneous, alternating, pulsing of direct current power supplies of opposite polarities, and employing variable pulse widths and voltage amplitudes as well as variable pulsing frequencies, waves of mixed and balanced ions are created which effectively preclude the undesirable proximity charging.

OBJECTS

Accordingly, it is a principal object of the present invention to provide a new and improved room ionization system for protecting sensitive objects from damage due to electrostatic discharge.

Another object of the invention is to provide a room ionization system in which a grid of ion-emitters are energized by first and second high direct-current voltage sources of opposite polarities, with the polarities being switched at a predetermined frequency whereby the high voltage corona discharge occurring at the emitters produces balanced quantities of mixed polarity ions in waves which propagate through the room being treated to effectively neutralize objects bearing an electrostatic charge.

Yet another object of the invention is to provide a room ionization system which is less subject to the buildup of unsightly dirt particles proximate the ion-emitting electrodes and neighboring surfaces.

Still another object of the invention is to provide a room ionization system in which proximity charging of objects is significantly reduced.

These and other objects and advantages of the invention will become apparent to those skilled in the art from the following detailed description of a preferred embodiment, especially when considered in conjunction with the accompanying drawings.

DESCRIPTION OF THE PREFERRED EMBODIMENT

Figure 1:
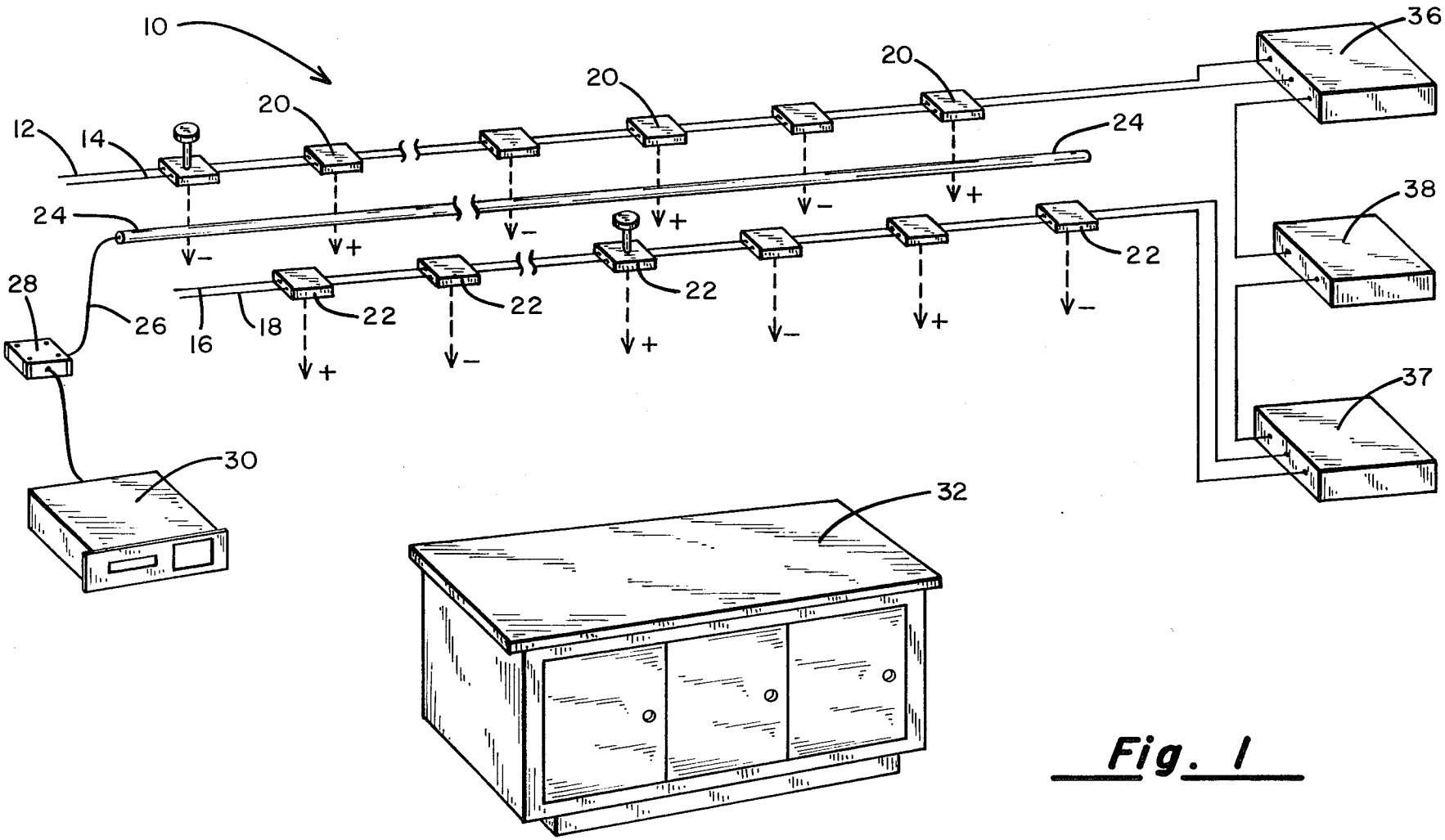
FIG. 1 is a perspective view of a room area embodying the air ionization system of the present invention.

Referring first to FIG. 1, there is illustrated the principal components of the room air ionization system of the present invention. It is referred to generally by numeral 10 and is seen to include a grid-like arrangement of a plurality of pairs of insulated conductive wires, the individual conductors of a first pair being identified by numerals 12 and 14 and the conductors of a second pair being identified by numerals 16 and 18. The insulated conductors 12 and 14 may be spaced apart from one another by a predetermined distance, typically ⅝ in., by means of emitter bars 20 which typically may be spaced from one another along the length of the conductors at 18 in. intervals. Likewise, the conductor pair 16-18 are held in spaced relationship by means of emitter bars 22. The number of conductor pairs employed in a given area depends upon the dimensions of the room in question, and typically, each pair is spaced from the other by approximately 4 ft. However, the foregoing dimensions are intended only to be illustrative of a typical installation and may vary from one installation to another.

Details of the construction of the emitter bars 20 and 22 and their mode of connection to the conductor pairs is set out in the Mykkanen U.S. Pat. No. 4,476,514, the contents of which are hereby incorporated by reference herein. As is set out in that patent, in the vicinity of each of the emitter bars 20 and 22, one or more pin-like electrodes or probes pass through the insulation surrounding the conductive wires within the conductor pairs 12-14 and 16-18 such that when the conductors are appropriately energized to a predetermined high voltage, a corona discharge occurs at the pointed tips of the projecting pins which ionizes the gas molecules in the air proximate the discharge points.

To effectively monitor the degree of ionization in the air, it is expedient to include an averaging bar 24 which is preferably oriented parallel to an equidistant between the conductor pairs. The construction an operational features of the averaging bar 24 are as set out in the Mykkanen et al patent application Ser. No. 787,417, filed Oct. 15, 1985, entitled "AVERAGING BAR" and assigned to the assignee of the instant application. The teachings of that application are also incorporated herein by reference.

The averaging bar 24 is connected by direct contact or a short cable 26 to the monitoring plate of a voltage sensing probe device 28 which, in turn, is connected to a voltage monitor/alarm 30. Again, the purpose and features of the probe and monitor are as explained in the aforereferenced application Ser. No. 787,417. Specifically, it has been empirically determined that the response of the probe 28 when coupled to the averaging bar 24, provides close correspondence to the responses of various objects positioned at bench-top level such as on work surface 32 located several feet below the overhanging assembly 10. Thus, by monitoring the ion distribution at the averaging bars, the conditions at the working locations can be inferred. For those desiring further information concerning the construction and operation of the probe 28, reference is made to the Mykkanen patent application Ser. No. 550,688, filed Nov. 10, 1983, and entitled "ELECTRICAL MEASUREMENT" (now abandoned), the contents of which is hereby incorporated by reference.

Figure 2:
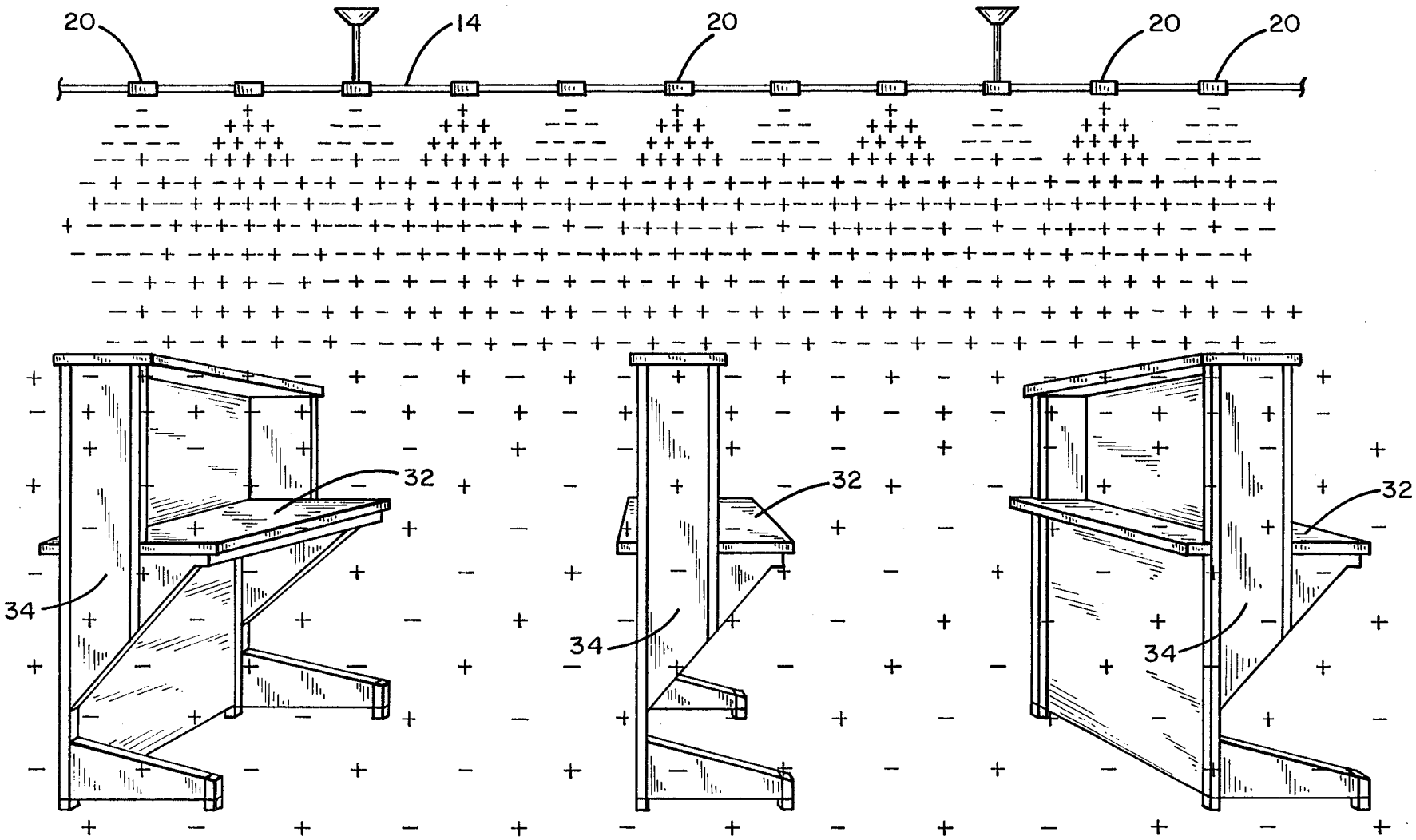
Fig. 2 PRIOR ART
FIG. 2 is a perspective view of a room area schematically indicating the ion distribution when the prior art ionization system is employed.

Referring to FIG. 2, there is schematically illustrated a typical distrubtion of ions emanating from a set of emitter cables such as 12 and 14 of FIG. 1. Specifically, with emitter cable 12 energized with a constant DC positive potential and emitter cable 14 energized by a constant negative DC potential and with the emitter bars 20 configured with emitter pins alternating in their connection to the positively and negatively energized emitter cables, negative ions will continuously be emitted from the location of a first emitter bar and positive ions will be emitted from the next adjacent emitter bar. As the ion wind and possible air currents within the room affect the charged ions, they propagate downwards and becomes mixed at the level of the work surfaces 32 of the benches 34. Thus, if static charges of either a positive or negative potential exist on objects on those work surfaces or on the surfaces themselves, in being flooded with ions of mixed polarity, the static charges are quickly neutralized.

With the continuous emission pattern produced by the prior art room ionization system as shown in FIG. 2, after a relatively short time, e.g., one to two months, dust and dirt tends to build up on and near the emitter pins, creating unsightly pock-marks on painted surfaces and general soiling of the ceiling, air vents, and the emitter bars 20 themselves. Cleaning operations are costly and can only be repeated a limited number of times before it becomes necessary to replace ceiling tiles, paint wall surfaces, etc. to maintain a pleasing aesthetic appearance to the room in which the air ionization system is installed.

Figure 3:
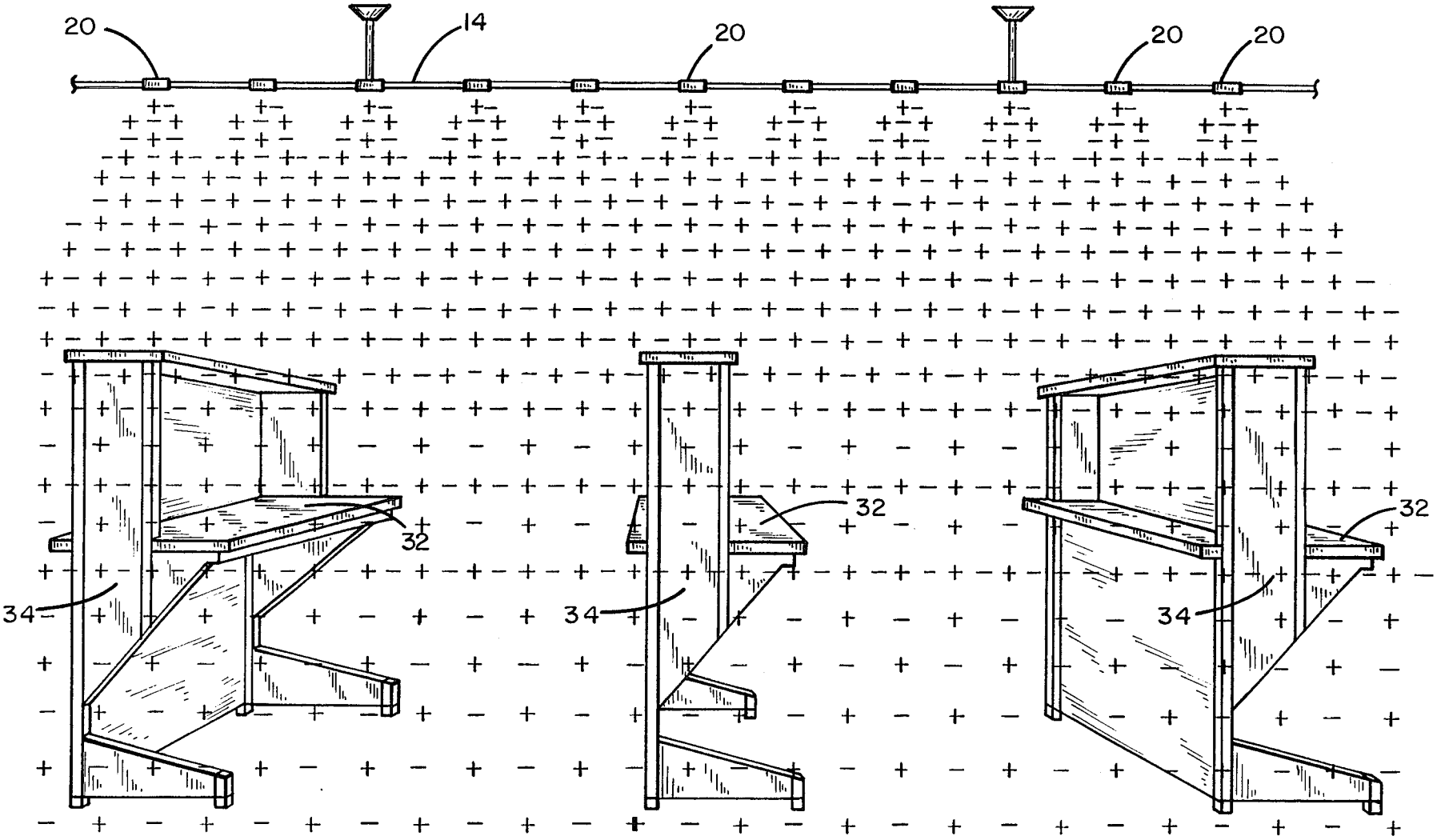
FIG. 3 is a perspective view of a room area schematically indicating the ion distribution when the system of FIG. 1 is employed.

The present invention considerably reduces the accumulation of unsightly dirt particles on and near the components comprising the room air ionization system. Rather than continuously energizing the emitter cables such as 12-14 and 16-18 in FIG. 1 with constant DC potentials of opposite polarity, the power supplies 36 are controlled by a pulser control network 38 so that at periodic intervals, the polarities of the voltages applied to the emitter cables 12-14 and 16-18 are reversed so that the cable that at the preceding instant had been energized with a positive voltage now becomes energized with a negative voltage and vice-versa. The synchronized 180 degree out-of-phase continuous, simultaneous pulsing is found to produce waves of mixed and generally balanced ions, such as indicated schematically in FIG. 3, instead of waves of single polarity unbalanced ions as reflected in the schematic diagram of FIG. 2. The pulsed, synchronized polarity reversals results in a tendency to both attract and repel contaminate particles with each pulse, thus tending to cause the dirt particles to remain airborne or to settle on the floor and table surfaces where routine janitorial services dispose of the dirt.

Figure 4:
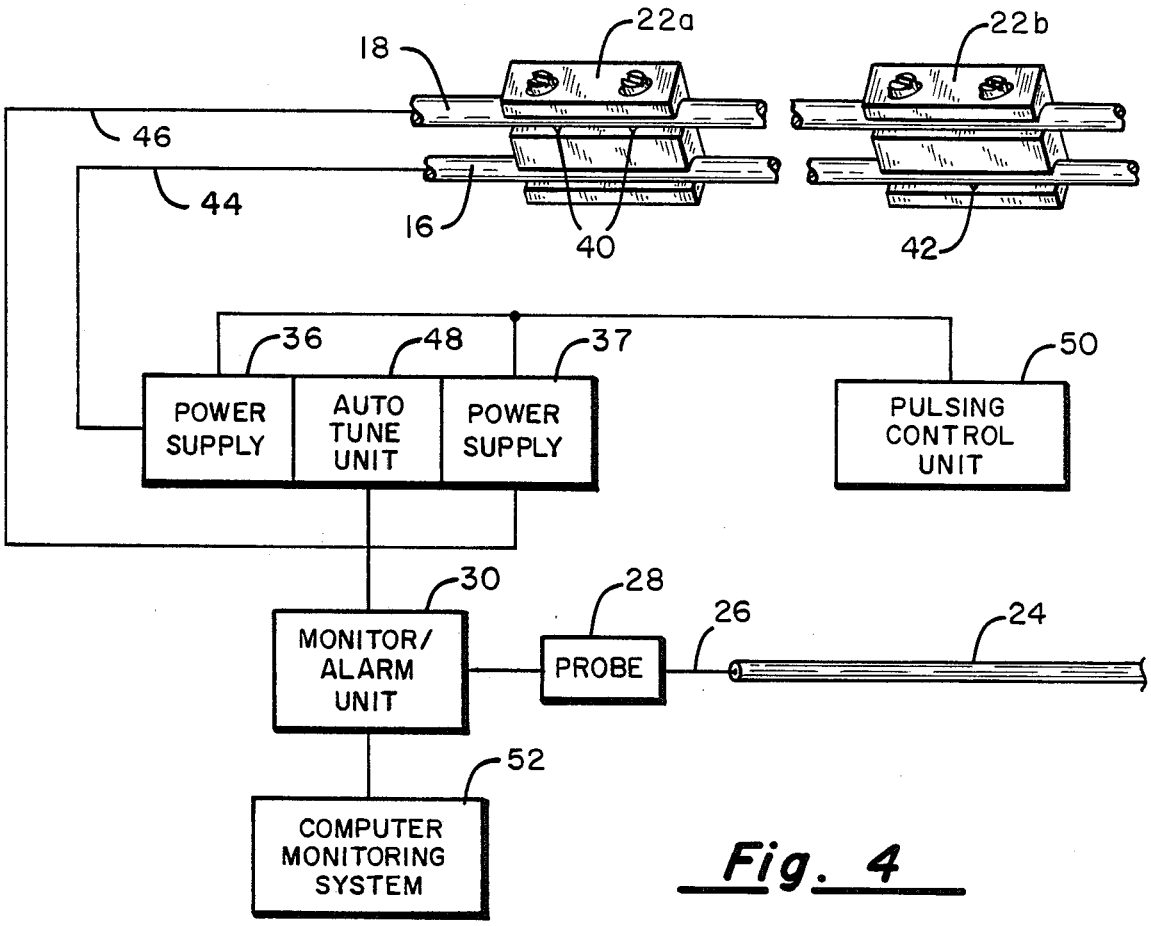
FIG. 4 is a block diagram of the electronic system used to energize the emitter grids.
Figure 5:
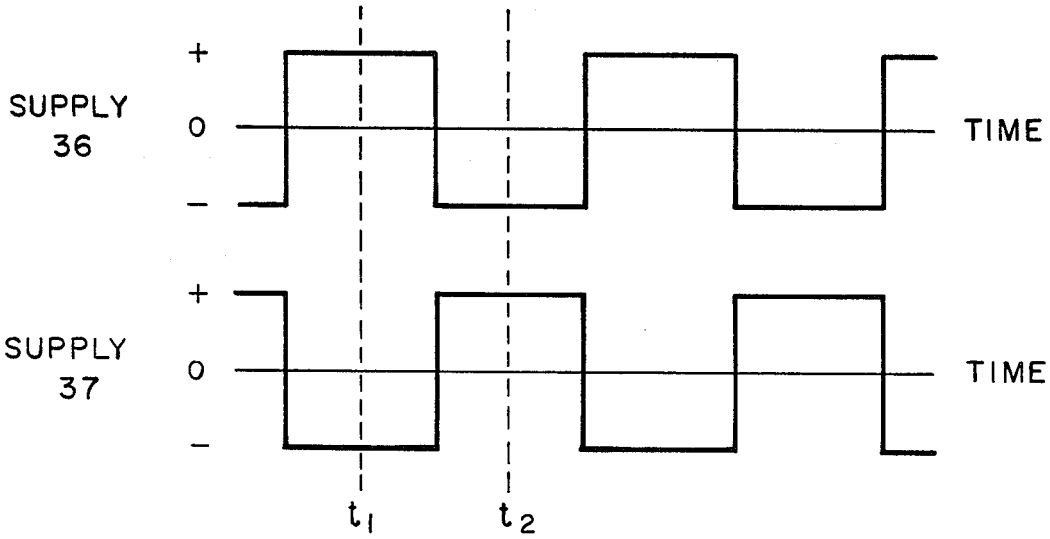
FIG. 5 illustrates the output voltages from the power supplies shown in FIG. 4.

To better understand the system of the present invention, reference is next made to the electronics block diagram of FIG. 4 and to the associated waveforms of FIG. 5. As shown in FIG. 4 are emitter conductors 16 and 18 along with two adjacent emitter bars 22*a* and 22*b* clamped thereto for maintaining the insulated conductor 16 and 18 in a desired parallel spaced-apart relationship. The emitter bar 22*a* is shown as having two sharply pointed pin electrodes 40 extending through the insulation on the conductor 18 while the emitter bar 22*b* is shown as having a single projecting pin electrode 42 in contact with the conductor wire of emitter cable 16. As is indicated in FIG. 1, the conductor to which the electrode pins are connected alternate between emitter cables 16 and 18 at each adjacent emitter bar.

A high voltage DC power supply 36 is connected by way of a conductor 44 to the emitter cable 16. Similarly, a high voltage direct current power supply 37 is connected by a conductor 46 to the emitter cable 18. An automatic tuning control unit 48 is coupled to the monitor/alarm unit 30 which, in turn, receives as its input a signal from the probe 28 associated with the averaging bar 24. The auto tune unit is effective to control the relative amplitude of the direct current voltage provided by the power supplies 36 and 37.

Also connected to the power supplies 36 and 37 is a pulsing control unit 50. The unit 50 provides a means for adjusting the frequency and dwell time of the high voltage direct current pulsed outputs from the power supplies 36 and 37. More particularly, and with reference to FIG. 5, at any given instant of time, such as at time $t_1$, power supply 36 may be applying a high positive voltage to emitter cable 16, causing positive ions to be emitted from electrodes 42 associated with the emitter cable 16. At the same time, the power supply 37 is applying a high negative potential to the emitter cable 18, causing negative ions to be emitted from the electrodes, like electrodes 40, associated with the emitter cable 18. At a subsequent time, such as time $t_2$, the polarities of the respective power supplies 36 and 37 are reversed from that at time $t_1$ whereby negative ions are now emitted from the electrodes associated with emitter cable 16 and positive ions are emitted from the electrodes associated with the emitter cable 18.

In a specific implementation installed in applicant's assignee's plant, the pulsing control unit 50 was set to reverse the polarity of the output from the respective supplies 36 and 37 at approximately at 10 Hz rate. Because an adjustable duty cycle is provided for, control can be had over the length of time that a given one of the power supplies 36 and 37 is applying a potential of a predetermined polarity. This fact, coupled with the amplitude control provided by the auto tune unit 48, allows precise control over the mix of positive and negative ions produced by the system.

While not specifically a requirement for the present invention, in a large installation where a plurality of monitors 30 and power supplies 36 and 37 are involved, a central data collection and analysis system has proven beneficial. The monitor/alarm unit 30 may be connected to the input/output port of an intelligent terminal 52 which, while not specifically shown, also is coupled to the monitor/alarm unit 30 of additional emitter cable assemblies. Thus, in a typical factory, several intelligent nodes will be distributed throughout and each has the capability to typically measure the outputs from up to 16 monitor/alarm units. All such intelligent nodes then comprise drops on a single processor communications cable that emanates from a central host processor (not shown). In that the air ionization system of the present invention involves fairly low data rates, typically 30 bits per second of control messages, the bandwidth of the communications media linking the nodes and the host processor together is more than ample to handle the control message switching and distribution functions while performing unrelated tasks on a time shared basis.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to equipment details and operating procedures, can be accomplished without departing from the scope of the invention itself.

What is claimed is:

1. In a room ionization system for neutralizing electrostatic charges in said room, said system being of the type including at least one pair of elongated, spaced-apart insulated wire conductors suspended in said room, each having a plurality of spaced apart conductive pins penetrating the insulation and contacting said wire conductors, said pins terminating at their exposed ends in sharp points, and power supply means for applying a predetermined direct current voltage of opposite polarity to said pair of wire conductors sufficient to emit ions due to high voltage corona discharge from said sharp points, the improvement comprising:

pulsing control means coupled to said power supply means for cyclically and simultaneously altering the polarity of the direct current voltage applied to said pair of wire conductors at a predetermined rate, such that the voltage applied to each of said wire conductors is essentially 180 degrees out of phase with respect to the voltage applied to the other wire conductors, whereby waves of balanced and mixed positive and negative ions are produced.

2. The system as in claim 1 wherein said predetermined direct current voltages of opposite polarity are adjustable in amplitude.

3. The system as in claim 1 wherein the frequency of the cyclic aleration of the polarity of said direct current voltage is selectable.

4. The system as in claim 3 wherein the duty cycle of said cyclic alteration of the polarity of said direct current voltage is selectable.

5. A system for controlling the air ion content within a room comprising:

(a) at least one pair of spaced apart, parallel conductors insulatingly suspended a predetermined distance from the ceiling in said room;

(b) a plurality of air ionizing electrode pins electrically coupled to one of said pair of conductors at predetermined spaced locations therealong;

(c) a plurality of air ionizing electrode pins electrically coupled to the other of said pair of conductors at predetermined spaced locations therealong, each electrode pin associated with said one of said pair of conductors being generally equidistant from two adjacent electrode pins on said other of said pair of conductors;

(d) first and second bipolar direct current power supply means respectively connected to said pair of spaced apart conductors such that the two conductors in said pair of conductors are continuously held at constant predetermined voltage amplitudes of opposite polarity; and (e) control means coupled to said first and second power supplies for simultaneously and periodically reversing the polarity of said voltages applied to said two conductors at a preselected frequency.

6. A method of controlling the ion content of air within a room for neutralizing static electric charges on objects in said room comprising the steps of (a) providing first and second conductors extending parallel to one another within said room with spaced apart emitter pins along the length thereof;

(b) applying a constant amplitude direct current voltage of opposite polarity to said first and second conductors; and (c) periodically reversing the polarities of said constant amplitude direct current voltages applied to said first and second conductors at a preselected frequency.

7. The method as in claim 6 wherein the polarities are reversed at a frequency of about 10 Hz.

* * * * *

UNITED STATES PATENT AND TRADEMARK OFFICE

CERTIFICATE OF CORRECTION

PATENT NO. : 4,757,421

DATED : July 12, 1988

INVENTOR(S) : Charles Fred Mykkanen

It is certified that error appears in the above-identified patent and that said Letters Patent is hereby corrected as shown below:

Title Page, [75] should read:
[75] Inventor: Charles Fred Mykkanen, Minneapolis, Minn.

Column 7, line 20, delete "aleration" and put instead -- alteration --.

Signed and Sealed this

Eighth Day of November, 1988

*Attest:*

DONALD J. QUIGG

*Attesting Officer*

*Commissioner of Patents and Trademarks*